US005919077A

United States Patent [19]

Gondcaille

[11] Patent Number: 5,919,077

[45] Date of Patent: Jul. 6, 1999

[54] METHOD FOR ASSEMBLING ONE OR MORE WHEELS ON A MINIATURE VEHICLE AND MINIATURE VEHICLE PRODUCED

[75] Inventor: Pierre Gondcaille, Saint-Laurent-en-Grandvaux, France

[73] Assignee: Etablissements Maurice Charton, Saint Laurent En Grandvaux, France

[21] Appl. No.: 08/837,263

[22] Filed: Apr. 11, 1997

[30] Foreign Application Priority Data

Apr. 18, 1996 [FR] France ..... 96.05118

[51] Int. Cl.[6] ..... A63H 17/267

[52] U.S. Cl. ..... 446/469; 446/465; 446/95

[58] Field of Search ..... 446/95, 465, 469

[56] References Cited

U.S. PATENT DOCUMENTS

| | | | |
|---|---|---|---|
| 3,520,080 | 7/1970 | Fairbairn | 446/465 |
| 3,713,247 | 1/1973 | Parrilla | 446/95 X |
| 4,361,980 | 12/1982 | Chatani | 446/469 |
| 4,375,139 | 3/1983 | Chatani | 446/471 |
| 5,380,231 | 1/1995 | Brovelli | 446/471 X |

FOREIGN PATENT DOCUMENTS

| | | |
|---|---|---|
| 1166358 | 2/1957 | France . |
| 1558783 | 3/1968 | France . |
| 1120956 | 12/1961 | Germany . |
| 1004915 | 9/1965 | United Kingdom . |

*Primary Examiner*—Robert A. Hafer
*Assistant Examiner*—Laura Fossum
*Attorney, Agent, or Firm*—Dowell & Dowell, P.C.

[57] ABSTRACT

A miniature vehicle and method for assembling one or more wheels on the vehicle which includes a chassis and a bodywork, wherein the method consists of introducing one end of a hub extending from a wheel through a stop element integrally formed with one of the chassis or the bodywork and maintaining the hub in position between opposing surfaces of the stop element. The vehicle produced is characterized in that each wheel is secured to a hub having an outer flange adapted to cooperate with the stop elements formed in one of the chassis and the bodywork in order to retain the hub against translation forces relative to an axis of a hub and wheel assembly.

7 Claims, 5 Drawing Sheets

1

METHOD FOR ASSEMBLING ONE OR MORE WHEELS ON A MINIATURE VEHICLE AND MINIATURE VEHICLE PRODUCED

BACKGROUND OF THE INVENTION

1. Field of the Invention

The present invention relates to a method for assembling one or more wheels on a miniature vehicle, and to a miniature vehicle.

2. History of the Related Art

In miniature vehicles, which most often constitute toys for children, the wheels belonging to the same set of wheels are usually joined together, in rotation and in translation, by an axle, i.e. the wheels of the same axle rotate at the same time. This linkage in rotation and in translation is detrimental to the ability of these miniature vehicles to take corners and may lead to the child losing interest in the game. Certain miniature cars possess wheels which are independent in rotation on the same axle. In this case, these wheels are mounted by means of complex systems on the chassis or bodywork of the vehicle, which increases production costs thereof correspondingly and most often renders it fragile, which is incompatible with the use of the vehicle as a toy for a young child, in particular for a child younger than 36 months.

U.S. Pat. 5,380,231 proposes a miniature vehicle in which the attachment of the wheels is so unstable that the vehicle comes apart spontaneously in the event of a shock. The temporary attachment of the wheels on the chassis is effected without a stud element but by means of a complex device comprising spring-controlled levers.

In all cases, the tear resistance of the wheels obtained with prior-art devices is low and does not comply with the standards in force or planned. Moreover, the known devices are delicate to assemble, i.e. it is a long and expensive operation.

It is an object of the present invention to overcome these problems by a method for assembling one or more wheels on a miniature vehicle allowing an efficient attachment of the wheel or wheels with respect to the rest of the vehicle and a free rotation of one wheel with respect to the other wheel of the same set of wheels.

SUMMARY OF THE INVENTION

To that end, the invention relates to a method of assembling one or more wheels on a miniature vehicle comprising a chassis and a bodywork, characterized in that it consists in driving the end of a hub of a wheel through a stop element integral with or secured to chassis or, the bodywork, and in maintaining the hub in position driven in the stop element.

Thanks to the invention, assembly of a wheel on a miniature vehicle is particularly rapid and easy, as it suffices to exert a driving-in effort to position the wheel with respect to the vehicle.

According to an advantageous aspect of the method of the invention, the method may further consist in partially housing a spindle inside the hub of a first wheel, before driving the end of this hub through the stop element and in capping a free end of this spindle with a hub of a second wheel intended to be assembled opposite the first wheel by driving the end of the second hub through a second stop element integral with or secured to the chassis or bodywork. In this variant of the invention, a spindle, which may be made of metal, is thus captive between the two hubs of two wheels of the same set of wheels, which confers a good rigidity to the assembly thus formed, this spindle serving as axle for the set of wheels.

The invention also relates to a miniature vehicle assembled by the method of the invention, and to a miniature vehicle comprising a chassis, a bodywork and a plurality of wheels, characterized in that each wheel is integral with or secured to a hub bearing an outer flange adapted to cooperate with a stop element integral with or secured to chassis or said bodywork in order to immobilize said hub in translation in a direction of force with respect to the chassis or the bodywork.

In the miniature vehicle of the invention, cooperation of the flange of the hub and the stop element makes it possible to obtain a good tear force resistance of the wheel, insofar as the flange is adapted to immobilize the hub, and consequently the wheel, when a pull is exerted thereon to separate the vehicle.

In accordance with a first advantageous aspect of the device of the invention, the end of the hub remote from the wheel includes a chamfer adapted to facilitate introduction thereof in the stop element, this making it possible to correct an imprecise alignment of the hub and stop element when the hub is positioned opposite the stop element.

It may, in addition, be provided that the hub has at least one shoulder adapted to cooperate with the stop element, the chassis or the bodywork in order to immobilize the hub in translation in another direction with respect to the chassis or bodywork. Thanks to this aspect of the invention, the hub is therefore immobilized in the two directions of translation that it is capable of having with respect to the stop element. The only possible movement of the hub with respect to the stop element is therefore its rotation, which allows the wheel to rotate when the vehicle is moved.

According to another advantageous aspect of the invention, the hub is provided with a central orifice adapted to receive a part of a spindle forming the axle of a set of two wheels, which makes it possible to rigidify the assembly thus obtained.

According to a first embodiment of the invention, the stop element is formed by two deformable studs integral with the chassis or bodywork. The deformation of the studs allows the passage of the flange of the hub when it is introduced in the stop element. In this case, the bodywork of the vehicle may also be provided to include a stop adapted to abut against the hub so as to avoid pivoting thereof about an axis perpendicular to its principal axis.

According to a second embodiment of the invention, each stud comprises an under-cut end allowing the hub to be maintained in position.

In accordance with a third embodiment, the stop element may be formed by a block having a circular orifice centered on the axis of the hub of the wheel. The end of the hub is driven in this orifice thanks to the deformation of the block or of the flange of the hub. In this case, the hub may be formed by a plurality of supple plates, which allows such deformation.

Finally, according to another advantageous aspect of the invention, the hub is integral with the wheel. The hub may thus be force-fitted in the wheel. In any case, it constitutes therewith, possibly after fit thereof, a single piece easy to manipulate during the assembly operations and which cannot be dismantled by a child playing with the vehicle.

BRIEF DESCRIPTION OF THE DRAWINGS

The invention will be more readily understood on reading the following description of three embodiments of a miniature vehicle with reference to the accompanying drawings, in which.

DESCRIPTION OF PREFERRED EMBODIMENTS

Figure 1:
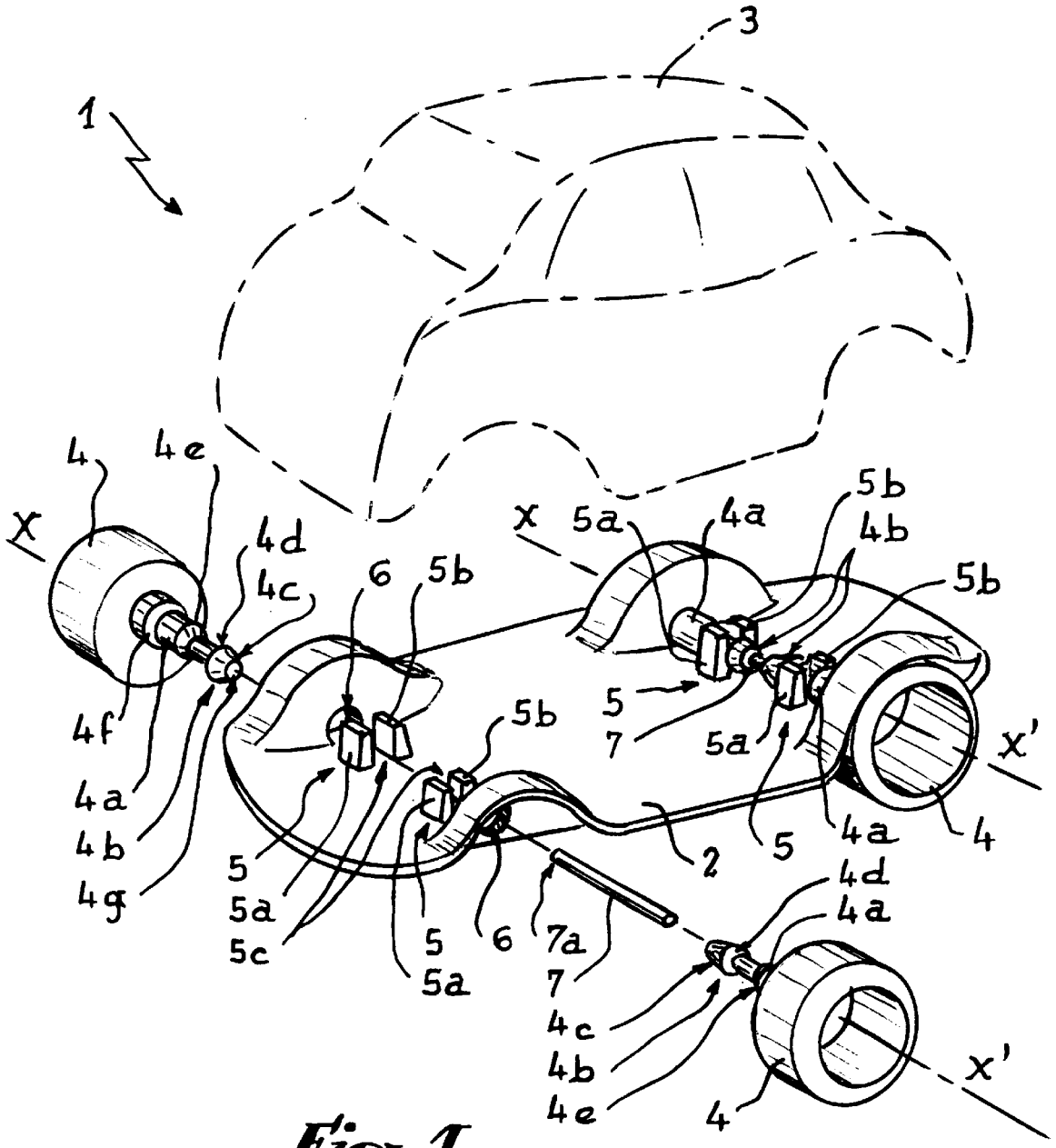
FIG. 1 is a schematic view in perspective of a miniature vehicle being assembled.

Referring now to the drawings, the vehicle 1 of FIG. 1 essentially comprises a chassis 2 and a bodywork 3 mounted on the chassis by any suitable means within the scope of a person skilled in the art. Four wheels are distributed between a front set, formed by two front wheels of which the axes of rotation are aligned and a rear set formed by two rear wheels whose axes of rotation are likewise aligned. Each wheel comprises a hub 4*a* integral therewith and capable of supporting it.

According to the invention, each hub 4*a* has an outer flange 4*b*, i.e. extending radially with respect to the axis of the hub 4*a*. Stop elements 5 are formed on the upper surface of the chassis 2, constituted by two studs 5*a* and 5*b* integral with the chassis and separated by a space 5*c* whose width is slightly smaller than the diameter of the flange 4*b*. The chassis 2 also comprises four orifices 6, of which two are visible in FIG. 1, through which the hub 4*a* of each wheel 4 may be inserted in the direction of the corresponding stop element 5.

When the flange 4*b* comes into contact with the studs 5*a* and 5*b*, the latter are deformed and move apart, with the result that the width of the space 5*c* is momentarily increased, which allows passage of the flange 4*b*. In this way, the end of the hub 4*a* constituted by the flange 4*b* is introduced through the stop element 5. In order to facilitate such introduction, the end of the hub 4*a* includes a chamfer tapered conical portion 4*c* which constitutes the front face of the flange 4*b*. The axial effort exerted by the installer on the wheel 4 is therefore transformed, thanks to the chamfer 4*c*, into a radial and axial effort which makes it possible to move the studs 5*a* and 5*b* apart, using their deformable character.

On the contrary, the rear face 4*d* of the flange 4*b* facing the wheel 4 is substantially radial, with the result that, when the flange 4*b* has passed beyond the studs 5*a* and 5*b*, the rear face 4*d* constitutes a radial bearing face for the flange 4*b* on the studs 5*a* and 5*b*. Taking into account the geometry of the studs 5*a* and 5*b*, they are much more difficult to deform in a direction parallel to the axis XX' common to the hubs of the two wheels of the rear set of wheels, with the result that they are not deformed when an effort of force in the plane of the axis XX', is exerted on wheel 4. In this way, the flange 4*b* and the stop element 5 are adapted to immobilize the hub 4*a* in translation in a direction of force of the wheel 4 with respect to the chassis 2.

In accordance with the method of assembly of the invention, the end of the hub 4*a* formed by the flange 4*b* is introduced through the stop element 5 and the hub 4*a* is maintained in position driven in the stop element 5 thanks to the geometry of the flange 4*b* .

Furthermore, the hub 4*a* has two shoulders 4*e* and 4*f* adapted to rest respectively against the edge of the studs 5*a* and 5*b* and against the edge of the orifice 6, when the end of the hub 4*a* is introduced beyond the stop element 5 with respect to the orifice 6. These two shoulders 4*e* and 4*f* of which one, for example shoulder 4*e*, may be constituted by a chamfer, serve to immobilize the hub 4*a* in translation in the direction of penetration of the hub 4*a* through orifice 6. In other words, their function is to prevent the wheel 4 from being driven too far in the orifice 6 or in the stop element 5.

According to an advantageous aspect of the invention, the vehicle of the embodiment of FIGS. 1 to 4 also comprises a spindle 7, for example metallic, partially inserted inside a central orifice 4*g* of the hub 4*a* of the wheels 4. When the two ends of the spindle 7 are capped by the hubs 4*a* of the two wheels of a set of wheels, this spindle constitutes an axle which gives a good mechanical stability to the set of wheels thus formed. In particular, it avoids any pivoting of the hub 4 perpendicularly to axis XX' in a direction which would tend to move the end 4*b* of the hub 4*a* away from the upper surface of the chassis 2.

Figure 2:
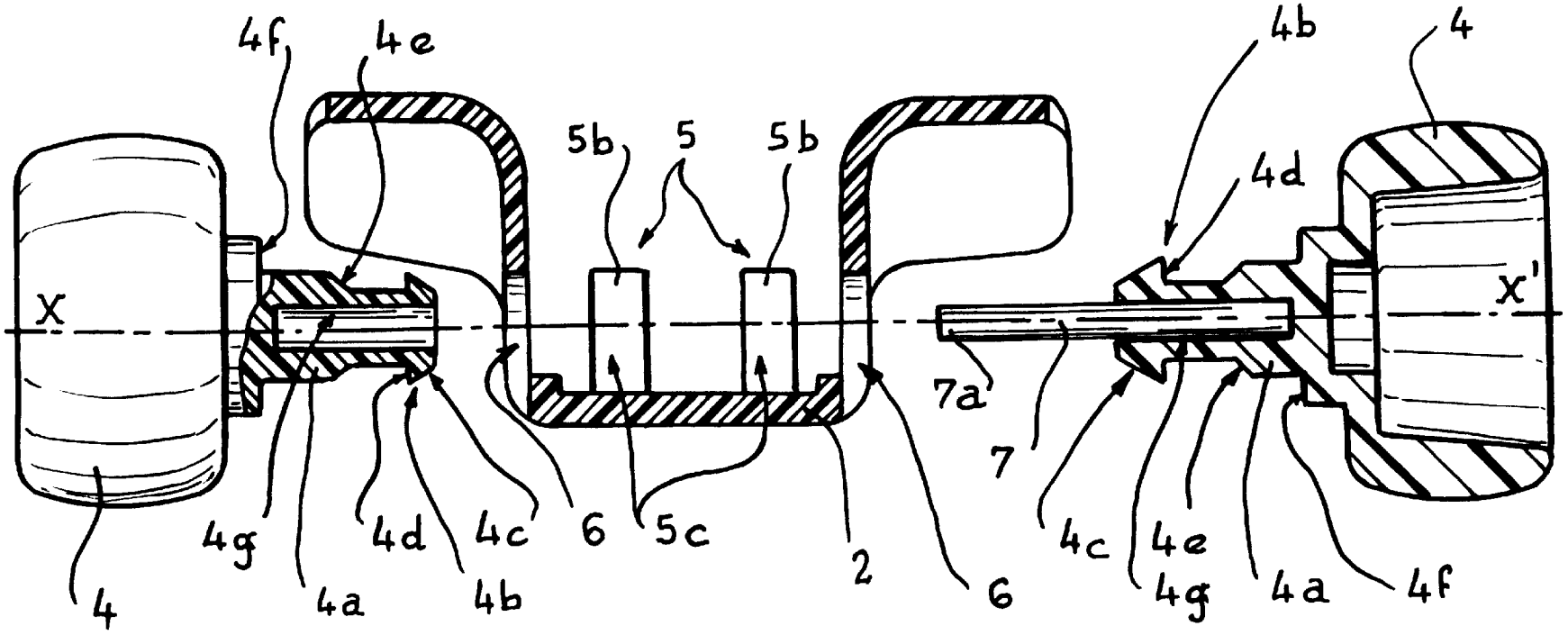
FIG. 2 is a view in section in the plane of the rear set of wheels of the vehicle of FIG. 1 being assembled, the bodywork having been removed.
Figure 4:
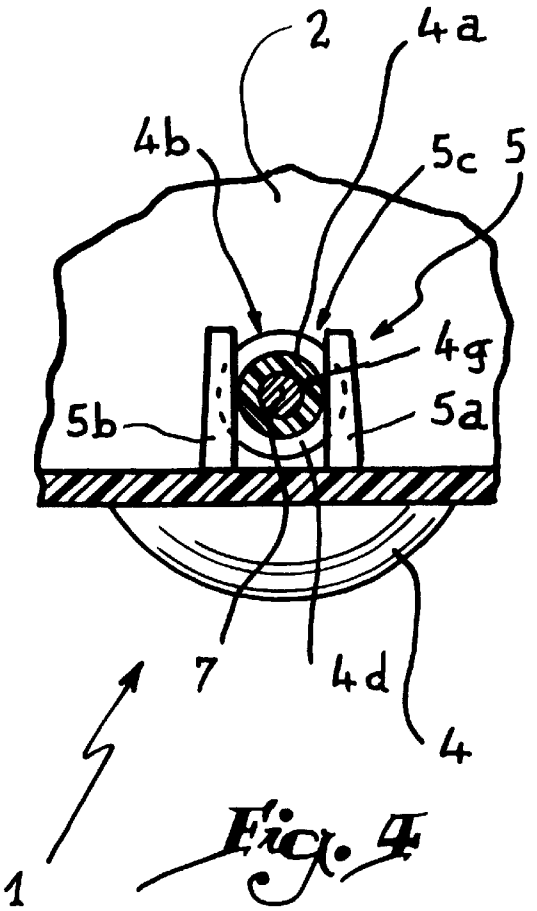
FIG. 4 is a view in section along line IV—IV of FIG. 3.

The method of assembly is as follows: the spindle 7 is partially housed inside the hub 4*a* of a wheel, a right one FIG. 2, then the hub 4*a* is introduced through the orifice 6 and its end 4*b* through the stop element 5. The free end 7*a* of the spindle 7 then passes beyond the hub 4*a* of the right wheel in the direction of the orifice 6 located on the left of FIG. 2. In this position, the end 7*a* is capped by the hub 4*a* of the left wheel by introducing the end of this second hub through a second stop element 5 the chassis 2, located to the left in FIG. 2.

Figure 3:
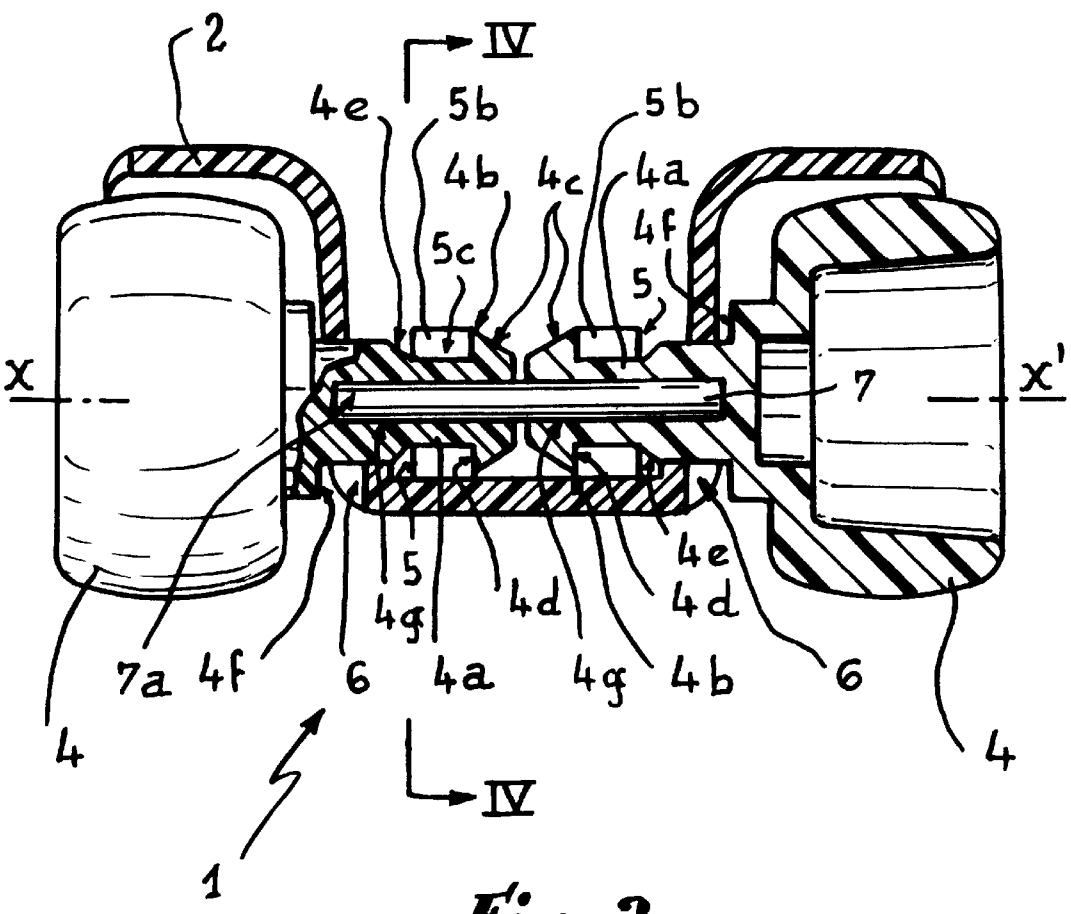
FIG. 3 is a view similar to FIG. 2, with the wheels assembled.

In this way, the assembly effected, as shown in FIG. 3, is solid and allows a good attachment of the wheels 4 on the chassis 2. The outer diameter of the spindle 7 may be smaller than the diameter of the central orifices 4*g* of the hubs 4*a*, with the result that the wheels 4 are free to rotate with respect to the spindle 7, which allows a differential speed of the wheels located to the left and right of the miniature vehicle, when the latter follows a curved path.

Figure 6:
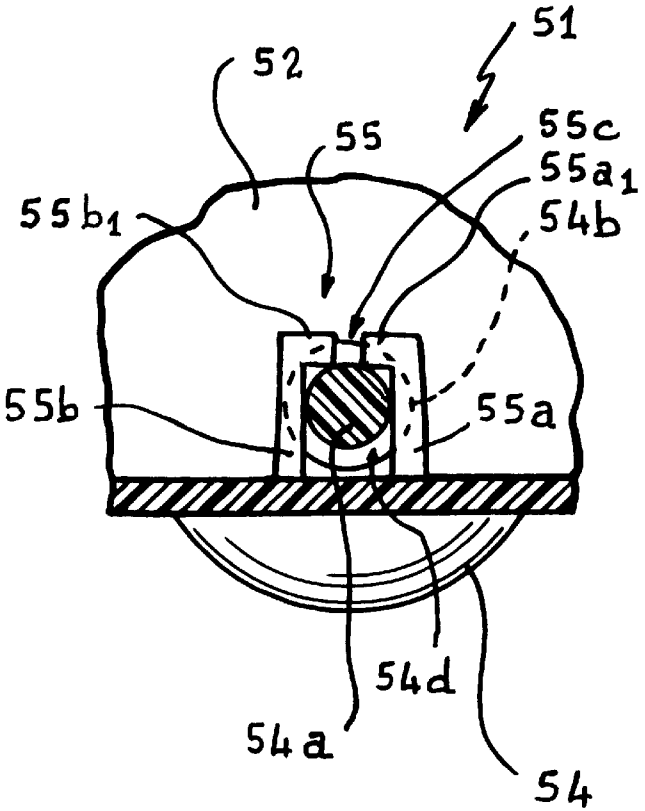
FIG. 6 is a view in section along line VI—VI of FIG. 5.
Figure 5:
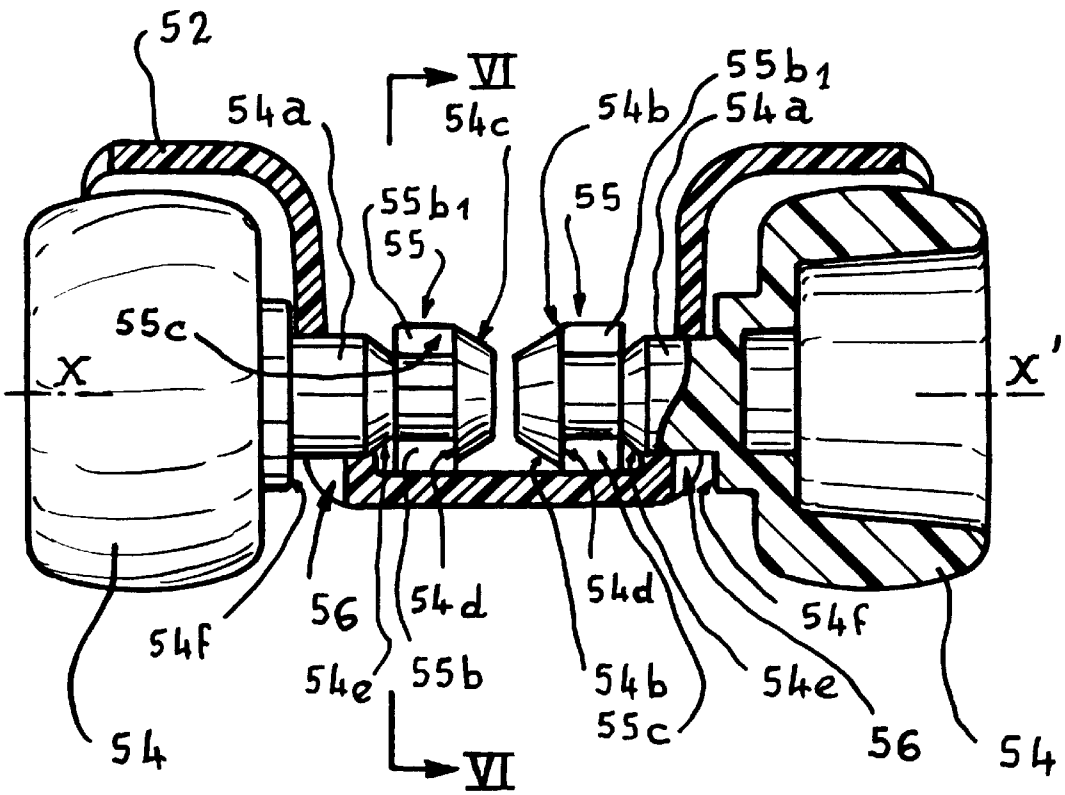
FIG. 5 is a view similar to FIG. 3, of a second embodiment of the invention, the left wheel being shown in outside view.

FIGS. 5 and 6 show a second embodiment of the invention, in which the constituent elements similar to those of the embodiment of FIGS. 1 to 4 have identical references increased by 50. This embodiment differs from the preceding one in that it does not provide a spindle joining the hubs 54*a* of two wheels 54 belonging to the same set of wheels of the vehicle 51. As before, each hub 54*a* comprises an outer flange 54*b* of which the front face is formed by a chamfer 54*c* facilitating introduction thereof through a stop element 55. Each stop element 55 is constituted by two deformable studs 55*a* and 55*b* integral with the chassis 52. Each hub 54*a* comprises, as before, a substantially radial rear flange face 54*d* and two shoulders 54*e* and 54*f* adapted to immobilize, in the direction of penetration, the wheel 54 with respect to an orifice 56 of the chassis 52 and to the stop element 55. As before, the flange 54*b* cooperates with the stop element 55 to immobilize the hub 54*a* in translation in the direction of the plane of the axes XX'.

The studs 55*a* and 55*b* each comprise an end, 55*a*l and 55*b*l respectively, in under-cut with respect to the space 55*c* made between the two studs 55*a* and 55*b*, with the result that, when the hub 54*a* is engaged in the space 55*c*, it is retained upwardly by the ends 55*a*l and 55*b*l. This makes it possible to avoid pivoting movements of the wheels 54 with respect to a horizontal axis perpendicular to axis XX'.

In accordance with an alternative embodiment of the invention (not shown), it is also possible to provide that the bodywork of the vehicle comprises a stop which, when the bodywork is mounted on the chassis 52, is adapted to come into abutment against the upper face of the hub 54*a*. The function of this stop is also to avoid the above-mentioned pivoting of the hub 54*a*. In this case, the under-cut ends 55*a*1 and 55*b*1 may possibly be eliminated.

Figure 8:
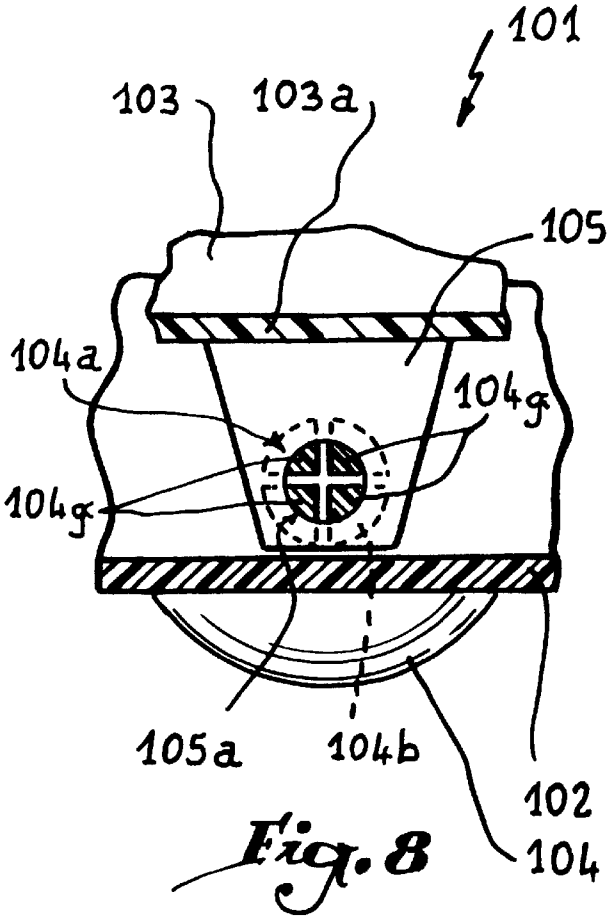
FIG. 8 is a view in section along line VIII—VIII of FIG. 7.
Figure 7:
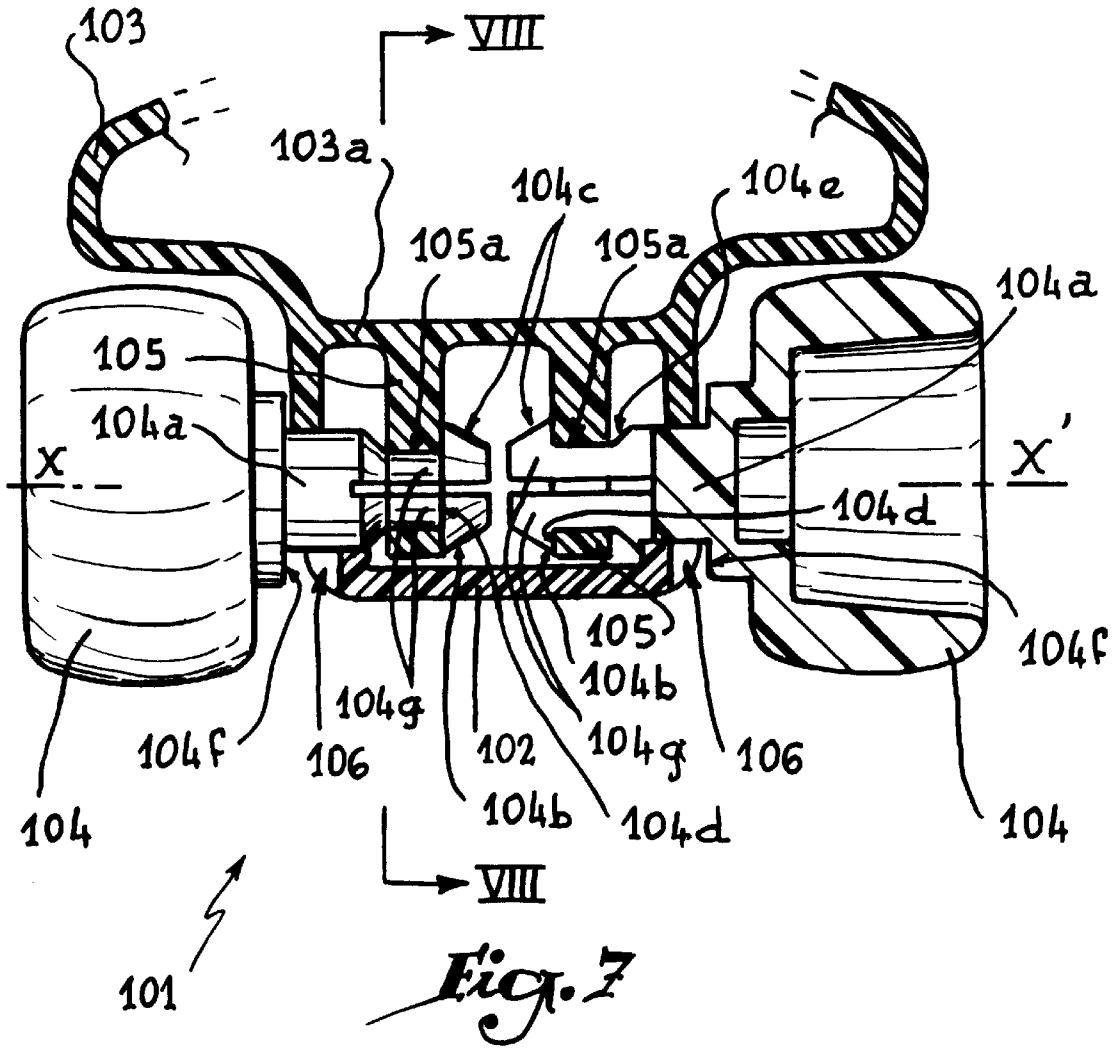
FIG. 7 is a view similar to FIG. 5 of a third embodiment of the invention.

FIGS. 7 and 8 show a third embodiment of the invention, in which the elements similar to those of the embodiment of FIGS. 1 to 4 have identical references increased by 100. This embodiment differs from the preceding ones essentially in that the stop elements 105 are carried by the bodywork 103 of the vehicle 101. This bodywork comprises a fairing 103*a* extending transversely above a chassis 102. Each stop element 105 is formed by a block integral with the fairing 103*a* having a circular orifice 105*a* centered on the axis XX' of the hubs 104*a* of the wheels 104 of the set of wheels in question.

Each hub 104 comprises at its end a flange 104*b* whose outer shape is substantially identical to that of the flanges 4*b* and 54*b* of the preceding embodiments. The hub 104*a* has a chamfer 104*c*, a radial rear face 104*d* and two shoulders 104*e* and 104*f*. This flange is adapted to cooperate with the stop element 105 in order to immobilize the hub 104*a* in the direction parallel to axis XX' thanks to the rear face 104*d* of the flange 104*b*. As before, the hub 104*a* has shoulders 104*e* and 104*f* opposing penetration of the wheel 104 in the bodywork 103 insofar as the shoulder 104*e* comes into abutment against the stop element 105 and/or the shoulder 104*f* comes into abutment against the edge of an orifice 106 made for example in the bodywork 103.

The orifice 106 is circular and centered on axis XX' of the hubs 104*a*. In order to allow deformation thereof when it must be introduced in the orifice 105*a*, the hub 104*a* is formed by a plurality of supple plates or fingers 104*g* which appear more particularly in FIG. 8, four in number. Thanks to their properties of suppleness, these fingers may be deformed in order to allow passage of the flange 104*b* in orifice 105*a*.

Hubs 54*a* and 104*a* of the second and third embodiments are, like hub 4*a* of the first embodiment, integral with the wheel to which they belong. However, it is also possible that the hub is constituted by a part distinct from the wheel and force-fitted in an axial orifice therein. In that case, the hub and the wheel constitute a unitary assembly which does not risk being dismantled by a child playing with the miniature vehicle of the invention.

It is, of course, possible to combine the characteristics of the different embodiments described, without departing from the scope of the invention. In particular, the hubs 54*a* and 104*a* may be provided with a central orifice for receiving a part of a spindle forming the axle of a set of two wheels.

What is claimed is:

1. A miniature vehicle comprising: a chassis, a bodywork, and a plurality of wheel assemblies, each wheel assembly including a hub portion extending from a wheel, each of said hub portions including a tapered end portion defining a radially outwardly extending flange, a plurality of spaced stop elements extending from said chassis, each of said stop elements including opposing studs which are integrally formed with said chassis and which are spaced at a first distance with respect to one another, a plurality of openings in said chassis, each of said openings being aligned with and spaced from one of said stop elements, said end portions of said wheel assemblies being adapted to be frictionally force-fitted between said opposing studs with said flanges extending outwardly a greater distance then said first distance to thereby prevent axial withdrawal of said wheel assemblies when said hub portions thereof are cooperatively seated within one of said openings and such that said wheel assemblies are retained in assembled relationship to said chassis when forces are applied to said wheels, and an opening formed in said outer end portion in each of said hub portions, a spindle element of a size to be received within said openings in a pair of aligned hub portions and connecting said pair of aligned hub portions to one another intermediate a pair of stop elements such that opposing wheel assemblies are rotatable with respect to said spindle and with respect to one another.

2. The miniature vehicle of claim 1 in which each of said hub portions includes a first inwardly tapered shoulder spaced in opposing relationship from said flange, said first shoulder and said flange being spaced so as to substantially abut opposite sides of said opposing studs.

3. The miniature vehicle of claim 2 wherein each stud comprises an outer portion extending towards an outer portion of the opposing stud to thereby form an under-cut in which said end portion of said hub portion is cooperatively received.

4. The miniature vehicle of claim 2 in which said hub portions are integrally formed with said wheels.

5. The miniature vehicle of claim 2 in which each of said hubs of said wheel assemblies includes a second outwardly extending shoulder spaced intermediate said first shoulder and the adjacent wheel of the wheel assembly, said second shoulder being provided to prevent lateral movement inwardly with respect to openings in said chassis.

6. The miniature vehicle of claim 1 in which each of said hubs of said wheel assemblies includes a second outwardly extending shoulder spaced intermediate said first shoulder and the adjacent wheel of the wheel assembly, said second shoulder being provided to prevent lateral movement inwardly with respect to openings in said chassis.

7. The method for assembling one or more wheels on a miniature vehicle wherein the miniature vehicle includes a chassis, a bodywork, and a plurality of wheel assemblies, wherein the chassis includes stop elements each having opposing studs extending from the chassis for cooperatively receiving an end portion of a hub associated with each wheel assembly and wherein each outer end portion includes an outwardly extending flange of a size to be force fitted through the opposing studs of one of the stop elements to prevent withdrawal of a wheel assembly relative thereto, and wherein each hub includes an opening oriented along a central axis of each wheel assembly for receiving one end of a spindle comprising the steps of:

inserting the end portion of a first of said wheel assemblies by force fitting between said opposing studs of one of said stop elements and extending a first end portion of said spindle within said opening of said hub of said first wheel assembly and thereafter inserting an opposing second of said wheel assemblies between opposing studs of another of said spaced stop elements so that said hub of said second wheel assembly is axially aligned with said hub of said first wheel assembly and forcing said second wheel assembly over an opposite end portion of said spindle such that the opposite end portion is seated within said opening of said hub of said second wheel assembly to thereby secure said first and second wheel assemblies to said spindle and said opposing studs extending from said chassis of said miniature vehicle.

* * * * *